United States Patent [19]

Wolford, Jr.

[11] Patent Number: 4,654,978

[45] Date of Patent: Apr. 7, 1987

[54] MARKING GUIDE FOR USE WITH METAL STUDS

[76] Inventor: Otis Wolford, Jr., 1105 N. Meadow La., Mt. Prospect, Ill. 60056

[21] Appl. No.: 785,064

[22] Filed: Oct. 4, 1985

[51] Int. Cl.[4] ..... B43L 13/00

[52] U.S. Cl. ..... 33/481; 33/403; 33/480; 33/474; 33/DIG. 1

[58] Field of Search ..... 33/480, 479, 419, DIG. 1, 33/481, 476, 474, 475, 403, 481

[56] References Cited

U.S. PATENT DOCUMENTS

| | | | |
|---|---|---|---|
| 204,428 | 6/1878 | Eaton | 33/419 |
| 660,876 | 10/1900 | West | 33/480 |
| 4,538,354 | 9/1985 | Smolik | 33/DIG. 1 |

FOREIGN PATENT DOCUMENTS

| | | | |
|---|---|---|---|
| 1163437 | 3/1984 | Canada | 33/479 |
| 2906921 | 9/1980 | Fed. Rep. of Germany | 33/481 |

*Primary Examiner*—William D. Martin, Jr.
*Attorney, Agent, or Firm*—Charles F. Lind

[57] ABSTRACT

The disclosed guide has an elongated planar body and a planar cross bar, angled normal to the body off one end edge thereof, somewhat in the configuration of a "T". One end of the cross bar projects away from the elongated body only a short distance, ¼ to ⅝ of an inch; while the other end of the cross bar projects 1⅛ to 1¼ of an inch away from the elongated body, corresponding to the width of the narrow side of a standard "metal stud" framing member. With the elongated body positioned against the wide side of the stud and the extended cross bar end squared against one narrow side of the stud, someone can consecutively mark both stud sides with this single guide setting; requiring the guide to be repositioned only once to mark the remaining narrow stud side. The extended cross bar is formed of a magnet material, effective to magnetically hold the guide against the metal stud (in this position, and/or in many different related positions) for easily measuring and marking the stud, squaring up the assembled framing structure, or temporarily storing the guide when not being used.

18 Claims, 7 Drawing Figures

FIG. 1
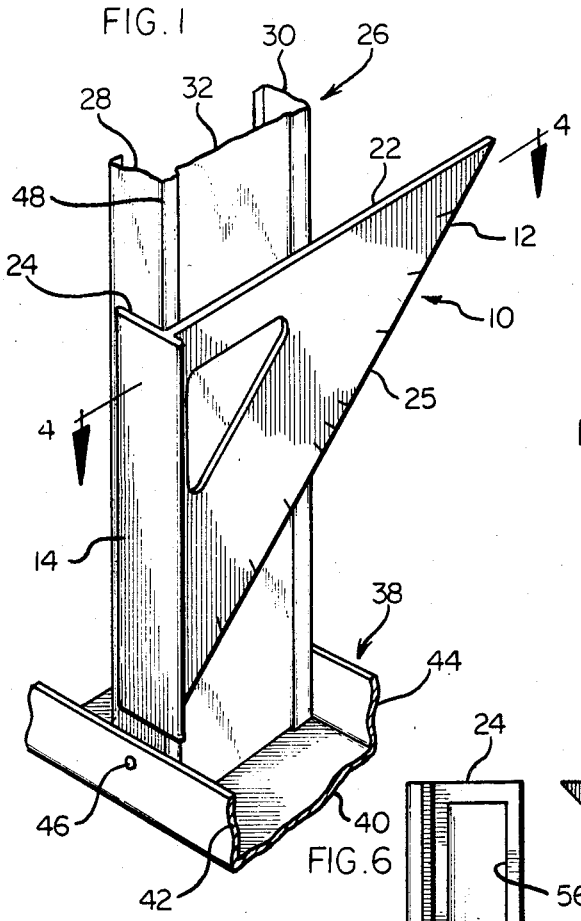
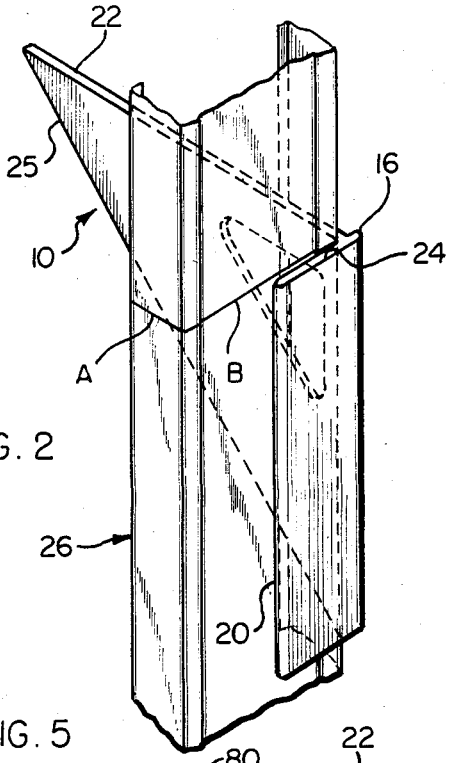
FIG. 2
FIG. 5
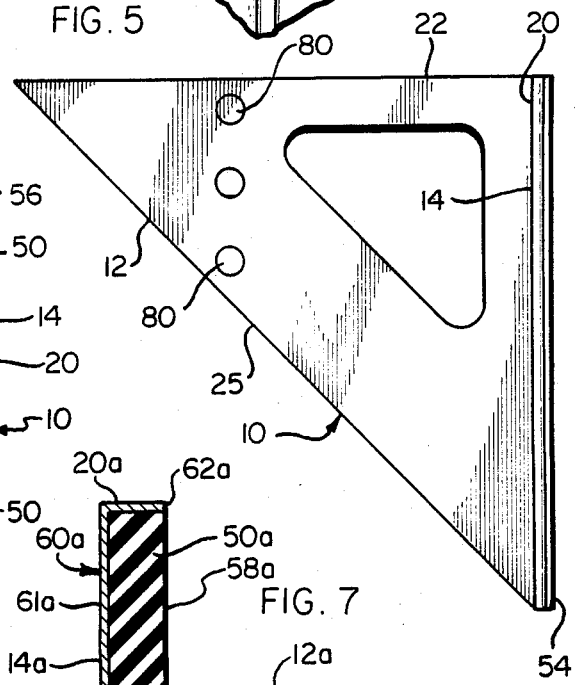
FIG. 6
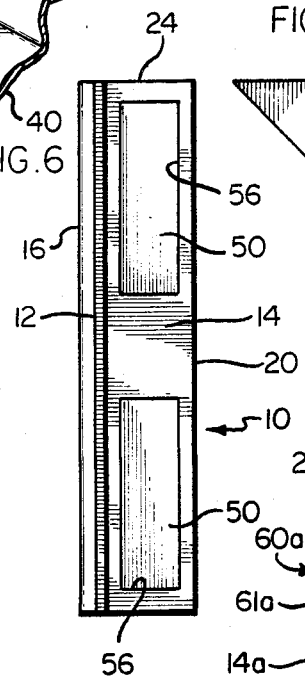
FIG. 3
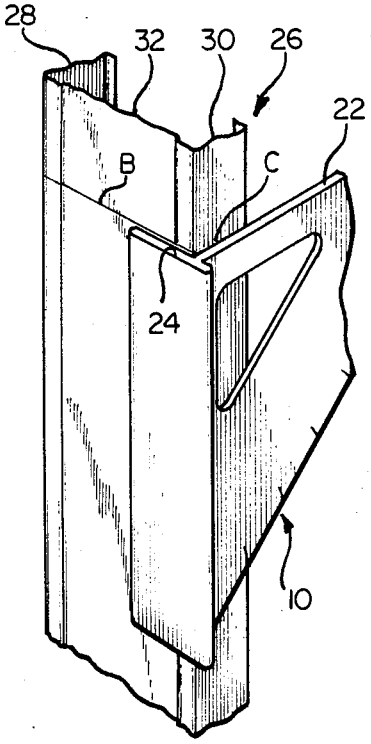
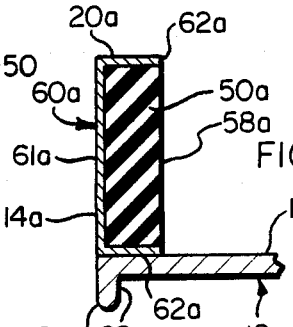
FIG. 7
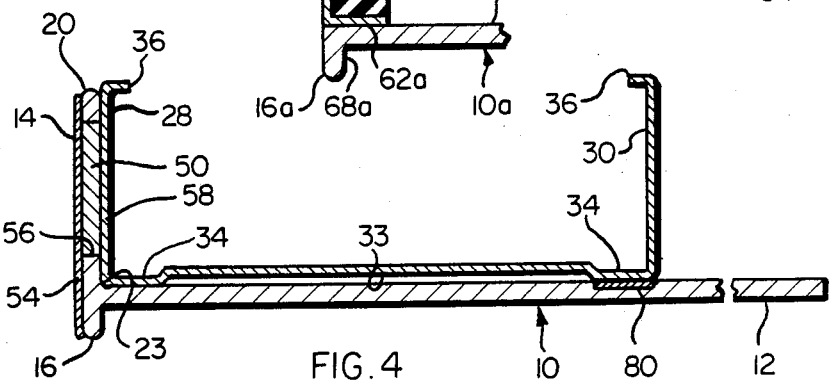
FIG. 4

MARKING GUIDE FOR USE WITH METAL STUDS

FIELD OF THE INVENTION

This invention relates to a guide, or square, adapted to be positioned against a framing member, such as a stud or the like, so as to allow accurate marking thereon for cutting-to-length, or to allow accurate squaring of adajacent members for in-the-field fabrication thereof. The invention has particular utility with metal framing, such as metal studs, that would generally be formed of steel.

BACKGROUND OF THE INVENTION

Interior walls, dividers, soffits or the like, frequently are formed of structural framing members covered on at least one side by sheets of paneling, plasterboard, or a combination of these, butted edge-to-edge. One form of framing member is of wood, as studs, in regular size cross-sections, such as 2"×2" or 2"×4", and of standard lengths of 8, 10 etc. feet, that would be cut in-the-field to the required lengths. Another form of framing member, particularly useful in commercial or industrial buildings, is of metal, using "metal studs" in place of the wood studs.

Normally, the metal studs fit, at their opposite ends, somewhat snuggly within header or base channel tracks; and small self-tapping screws, or "mini-screws", are driven through the overlapped adjacent track and stud to hold them together. Each stud may be of a C-shaped cross-section, having a pair of generally flat narrow sides or legs connected to one another across a generally flat wide side or web. Each track may also be of a C-shaped cross-section, having a base wall and two walls transverse thereto that are spaced apart a distance just slightly greater than across the outsides of the narrow sides of the studs. The mini-screws thus fit through the overlapping narrow sides of the studs and the upstanding walls of the track.

The framing stud may typically come in standard size cross-sections, generally $1\frac{1}{4}$ and $1\frac{3}{8}$ of an inch along the two narrow sides or legs, and $2\frac{1}{2}$, $3\frac{1}{2}$ or more inches along the wide side or intermediate web, depending on the size; and in standard lengths of 8 or 10 feet, etc., up to possibly even 30 feet. The metal framing member may be between possibly 12 or 14 gauge for load bearing walls, and 24 or 26 gauge for non-load bearing walls.

Normally, in-the-field cuts of the studs and/or squaring up of adjacent components must be made very accurately, or misfitting of the stud and track, and other components, may occur. This may be particularly true on jobs where the major portion of the heavy structural framing, or iron angles, are precut precisely to length, and/or where the other components, such as squared grid ceiling, mirror tiles, sliding glass windows or the like must be held in place by the framing, and are all precut precisely of true size and/or must be squared to fit together properly.

It might be possible, and generally even common, to cut each lighter gauge framing member to the required length by means of metal cutting shears; although a saw might be used. Generally, a saw is used for cutting the heavier gauge framing members.

In-the-field measurments, marks, and squaring ups may be made with conventional tools, including measuring tapes or rules, guides or squares, clamps and marking pencils. To cut the stud to length, the marks generally must be made around the three outside faces of the stud, on the two narrow side legs and across the wider interconnecting web. As the length of the stud, as cut, must be most accurate at the corners between the side legs and the interconnecting web, and at the side legs, it is common to measure to the wide side or web of the stud, and to mark this face with a single line extended to the corners of the stud, using a guide or square positioned against the web face and squared against the adjacent stud corner. The remaining marks, on the two side faces of the stud, are made by relocating the guide or square twice, once for making each mark, with the guide squared against the specific side face and lined up with the mark already made on the wide side web face of the stud.

One conventional square or guide, having only planar arms arranged at right-angles to one another, may be used by positioning one arm against one face of the stud, and lapping the inside edge of the other arm against the adjacent stud face, for making a mark on the one stud face. However, this square is not preferred as the planar guide faces are not flush against any of the stud faces, and thus may be unstable in use. Another conventional square or guide has an elongated planar arm (or body, as the arm frequently may be triangular in shape), and a cross bar integral with or secured to one edge of the elongated arm body to extend normal thereto, somewhat as a "T". Each cross bar end may project $\frac{1}{8}$ to $\frac{3}{8}$ of an inch away from the elongated body, just long enough to form a corner that can be squared against the stud corner, with the elongated body being positioned flush against the stud face. This guide is thus preferred over the first mentioned guide, for marking the one stud face, as it may be more stable in use.

A major drawback to either style guide or square is the need to position the guide or square three times, once each for marking on each face of the stud. This is time consuming and subject to error; and may even be dangerous or unnerving, if one is marking and cutting the stud while standing on a swaying ladder or scaffold, as might be typical on a construction project.

Once the framing members have been cut to length, they must then be assembled and secured together to define the intended framing structure. To do this, the studs and channel tracks may be temporarily clamped together, with each joint then being squared accurately relative to both the individual joint and the location of the overall intended structure. A major difficulty of using either style guide or square for these purposes, is the many things that must simultaneously be done and the limitation of having only two hands for one person to do them with. Thus, one might be called on to hold a measuring tape, rule, level or the like; a guide or square; and a tool such as hammer or screw gun; and be expected to measure, mark or secure the joints together . . . accurately. Again, wasted time and effor often result; as the same measurements may have to be repeated to conform the accuracy of the first, or even mismeasured work may have to be disassembled and redone.

Also, as the most preferred guide or square is of a triangular shape, it does not store well in many tool pouches typically carried around the waist of the user. Moreover, if the guide is carried in a pouch pocket, it may block access to the pouch pocket and hinder removal of other items (such as the mini-screws used to secure the overlapped studs and tracks together) carried in the same pocket. If not properly placed in the pouch pocket, the guide may accidentally fall out, to not only slow up the user's work output, but also to potentially damage the guide, or anyone or anything below the user on which the guide may fall.

OBJECTS OF THE INVENTION

One object of the present invention is to provide a guide, or square, that will be easy, quick and safe, for someone to use in initially measuring, marking and/or squaring framing members or the like, commonly used now in the building industry, where the same are to be cut to length, assembled and secured together to define an intended framing structure.

A more specific object of this invention is to provide a guide, or square, that will allow marking on three adjacent sides of a framing member or metal stud, with only two settings of the guide on, or relative to, the framing member.

Another specific object of this invention is to provide a guide, or square, that has means incorporated or carried directly thereon that allows the guide to be temporarily secured against and to, the metal framing members or studs, to allow for easy and accurate measuring and/or marking for cutting, and/or for locating and squaring adjacent framing members, and/or for temporarily and safely storing the guide while not being used by and/or carried on the person.

SUMMARY OF THE INVENTION

To achieve these and other objects, the present invention may provide a guide, or square, having a "T" shape, including an elongated planar member and a planar cross bar secured to or part of the elongated member along one edge thereof, where one end of the cross bar projects from the planar member a distance corresponding generally to the width of the narrow face of a conventional stud. This provides that one end of the cross bar may extend to the edge of the narrow face of the stud when the elongated planar member is positioned flat against the wide face of the stud and the cross bar is squared against the stud corner.

Magnet means may be secured to the guide, generally at the one cross bar end. This provides that the guide may become magnetically adhered to the metal framing member or stud, to assist one in measuring or in marking the member, or in squaring or locating adjacent framing members, or in temporarily and safely storing the guide, while the guide is not being used by or carried on the person.

BRIEF DESCRIPTION OF THE DRAWINGS

Further objects, advantages and features of the present invention will appear from the following disclosure and description, including as a part thereof the accompanying drawings, in which:

FIG. 1 is a perspective view of the guide, or square, in place against a metal framing member or stud, suited for marking the two adjacent faces of the stud, prior to cuting the stud to length;

FIG. 2 is a perspective view of the guide and metal framing stud illustrated in FIG. 1, except showing the guide repositioned against the stud, for marking the third adjacent stud face;

FIG. 3 is a perspective view of the guide and metal framing stud illustrated in FIG. 2, except showing them from about a quarter-turn shift in orientation compared to that used in FIG. 2;

FIG. 4 is a sectional view, slightly enlarged compared to the scale used in FIG. 1, as seen generally from line 4—4 in FIG. 1;

FIGS. 5 and 6 are elevational views of the guide illustrated in the previous figures; and FIG. 7 is a fragmentary sectional view, similar to FIG. 4, except of a second embodiment of the improved guide.

DESCRIPTION OF PREFERRED EMBODIMENTS OF THE INVENTION

The disclosed guide, or square, 10 has an elongated planar arm or body member 12, and a cross bar member 14 secured to one edge of the body 12 to extend normal thereto, somewhat in the configuration of a "T". One end 16 of the cross bar 14 projects from the elongated body 12 only a short distance, of the order of $\frac{1}{4}$ to $\frac{5}{8}$ of an inch; while the other end 20 of the cross bar 14 projects from the elongated body 12 a much greater distance, of the order of $1\frac{1}{8}$ to $1\frac{1}{4}$ inches.

The side edges 22 and 24 of the elongated body 12 and cross bar 14 member lie in a common plane disposed normal to the corner intersection 23 between the elongated body member 12 and cross bar 14. The elongated body member 12 is preferably triangular in shape (see FIG. 5), having the side edge 22 and the edge on which the cross bar 14 is located disposed normal to one another; and having the third edge 25 angled relative to these edges, at perhaps 45 degrees.

Each stud 26 may be of a C-shaped cross-section, having a pair of generally flat narrow sides or legs 28 and 30, connected to one another across a generally wide side or web 32. The stud 26 may have the wide side flat; or as illustrated, the wide side 32 may be recessed somewhat along the intermediate portion 33 between coplanar flat end areas 34, for strengthening the stud. Likewise, the free ends of the narrow sides 28 and 30 of the stud may be folded over as at 36 for strengthening the stud. Each track 38 may also be of a C-shaped cross-section, having a base wall 40 and two walls 42 and 44 folded transverse thereto that are spaced apart a distance just slightly greater than across the outsides of the narrow sides 28 and 30 of the stud 26. The self-tapping mini-screws 46 are driven through the overlapping narrow sides 28 and 30 of the stud 26 and the upstanding side walls 42 and 44 of the track 38.

As illustrated in FIG. 1, with the elongated triangular body 12 positioned flush against the wide side 32 (or end areas 34) of a framing member or stud 26, and the corner 23 between the cross bar 14 and the elongated body 12 squared flush against corner 48 of the stud between the wide face 32 and adjacent narrow side face 28, the side edges 22 and 24 are disposed normal to the stud corner. Moreover, the extended cross bar end 20 projects almost to the edge of the narrow side 28 of the stud. Thus, a person can consecutively mark, with this one guide setting, both narrow side face 28, as at "A", and long side face 32, as at "B" (the marks being illustrated in FIGS. 2 and 3 only).

The mark, as at "C", can be made on marrow side 30 of the stud with only one repositioning of the guide, from that illustrated in FIG. 1 to that illustrated in FIGS. 2 and 3. This places the elongated body member 12 against the short side 30 and the extended cross bar end 20 against the long side 32 (or flat area 34) of the stud, with edge 24 lined up with the mark "B" on the long side.

The stud 26 can thus be marked, on both narrow sides 28 and 30 and on the wide side 32, with only two guide settings.

Moreover, the extended cross bar end 20 has formed therein one or more pieces 50 (see FIGS. 4 and 6) of magnet material, to extend across a large area of the cross member end. As illustrated in FIG. 6, the extended guide end 20 is rectangular in normal plan, and each magnet piece 50 is of rectangular shape, the magnet pieces 50 being spaced apart but extended over a large part of the guide end 20. The guide end 20 may thus fit flush against a large flat area of the underlying framing member 26 or 38. The magnet means 50 is effective, when positioned flush against the metal framing member or stud, to magnetically hold the guide 10 in place against the metal framing member.

The magnet means 50 may be in the form of a ferromagnetic material, such as barium ferrite crystals, blended into a vinyl binder to define a generally flat piece that is flexible, and that has the opposite flat faces magnetized to opposite North and South magnetic poles of a permanent magnet.

The construction illustrated in FIGS. 4–6 provides that the elongated body member 12 and part of the cross bar 14 may be unitary, formed for example of a non-magnetic material such as a cast aluminum or zinc alloy; and a backing sheet 54 of a magnetic material such as steel, may be extended over the full surface of that part of the cross bar 14 and secured, as by bonding, to the cross bar. The magnet pieces 50 extend almost entirely across the width of, and over large portions of the length of the extended cross bar end 20. Each magnet piece 50 fits within an opening 56 in the extended end 20, and may be bonded to the backing sheet 54. The exterior face 58 of each magnet piece 50 and the reference face of the proximate extended end 20 are coplanar, and lie normal to the elongated body member 12. The elongated cross bar end thus completely surrounds the side edges of the magnet pieces, to protect them against wear or damage; and moreover provide the reference surface of metal to mate against the metal framing member. The backing sheet 54, being formed of a magnetic material, concentrates the magnetic forces at the exterior magnet face 58.

An alternate form of construction is illustrated in FIG. 7. In this embodiment, an extended end **20*a* may be formed with a dished-out metal piece 60*a* having a base 61*a* and short peripherial walls 62*a* disposed transverse thereto, and magnet means 50*a* may be secured or bonded to the metal piece within the walls. One of the walls 62*a* may be secured to elongated body member 12*a*, as by bonding or spot-welding. The magnet means 50*a* may be of one piece construction extended over most of the length of the extended end 20*a*, surrounded on the four sides by the transverse walls 62*a*. The exterior surface 58*a* of the magnet pieces 50*a* and end edges of the walls 62*a* are coplanar, and lie normal to the elongated body member 12*a*. The walls 62*a* protect the side edges of the magnet piece 50*a* against wear or damage; and moreover provides a hard and durable reference surface of metal to mate against the metal framing member. The piece 60*a* is formed of a magnetic material such as steel, and concentrates the magnetic forces at the exterior magnet face 58*a*. Short end 16*a* of the cross bar 14*a* may be integral with the elongated body member 12*a***, the two being folded to be L-shaped.

As illustrated in FIG. 7, the exposed reference surface **58*a* of extended end 20*a* need not be coplanar with the corresponding exposed reference surface 68*a* of the short end 16*a* of the cross bar 14*a*. However, each surface is perpendicular to the adjacent face of the elongated body 12*a***; and any indicia for units, such as inches or centimeters, would be marked on the elongated body measured from the respective exposed reference surface.

The short guide end 16 (or **16*a*) will allow the guide to be squared against a framing member with the opposite side face of the elongated member 12 (or 12*a*) against the framing member, as compared to when the extended end 20 (or 20*a***) is against the framing member. It preferably will be between $\frac{1}{4}$ and $\frac{5}{8}$ of an inch long to allow firm seating of the guide against the corner, including even when the guide may be slid along the framing member, such as in finding the proper location to mark the framing member, or the like.

A typical elongated body of the guide 10 (or **10*a*) may be between 0.1 and 0.3 of an inch thick, sufficient for strength and durability; while the cross bar 14 (or 14*a*) may be between 0.1 and 0.4 of an inch thick, for strength and durability and for providing appropriate magnetic attraction. A triangularly-shaped guide 10 (or 10*a*) having equal side edges between 5 and 7 inches may weigh between 0.5 and 2.0 pounds. The magnet means 50 (or 50*a***) may be between 0.05 and 0.35 of an inch thick, and should provide sufficient magnetic attraction to the metal framing stud to hold this guide firmly, without allowing the guide to slide along on the stud, or to rotate around the position as squared against the stud. As the magnet means may extend almost the full length and width of the extended guide end (over at least three and perhaps up to eight square inches of area), the density of the magnetic flux need not be high. This allows the user to intentionally slide the guide along on the stud, or separate the guide from the stud, without difficulty.

FIGS. 4 and 5 disclose a further feature of the invention, where additional magnets 80 may be secured on the elongated planar body 12, spaced from the cross bar 14 a distance just short of the width of the wide side 32 of a typical metal stud 26. The magnet pieces 80 may be small discs received in cutouts in the adjacent surface of the elongated body, and having exterior faces coplanar with the body surface. As spaced from the guide corner 23, the discs overline the remote end flat 34 of the stud, when the guide is squared against the opposite stud cornrer. These magnets, along with the extended end magnets of the cross bar, stably hold the guide as squared against the metal stud, preventing wobble or turning of the guide as thus positioned against the stud.

While the above specification makes mention of the framing member as being a "stud", it will be apparant that the guide 10 may be used on other forms of framing members, such as on an enclosed box-shaped beam, an "I" beam, or the like. However, the guide 10 will have particular utility when used with a metal framing member formed of steel or other magnetic material, and in the standard configuration of a metal stud.

SUMMARY OF THE OPERATION

The disclosed guide 10 (or **10*a***) is extremely versatile in assisting one in measuring or marking for cutting individual studs, or for squaring up adjacent framing components, or for squaring up the entire intended framing structure, in that the guide may be positioned relative to the metal framing member, and temporarily held as positioned, from which reference measurments may be taken.

With the elongated body 12 (or 12*a*) positioned against the wide side 32 of the stud 26, and the extended "T" bar end 20 (or 20*a*) squared against the narrow side 28 of the stud (as illustrated in FIG. 1), the extended cross bar end projects virtually across the narrow side 28 of the stud. Thus, a person can consecutively mark, with this one guide setting, both this one narrow side 28 at "A" and the wide side 32 at "B". The guide 10 (or 10*a*) need only be repositioned once (to that illustrated in FIGS. 2 and 3), to locate the elongated body against the remaining narrow side 32 of the stud 26 and the extended cross bar end lined up with the mark "B" on the wide side 32, to make the mark "C".

Moreover, the extended cross bar end 20 (or 20*a*), being formed of a magnet material, magnetically holds the guide 10 in place against the metal framing member of stud 26. This may allow someone to use two hands for measuring where to mark the stud, in marking the stud, in squaring adjacent framing members, or in locating the stud relative to the intended finished framing structure; or for temporarily and safely storing the guide, when it is not being used and need not be carried around on the person.

Thus, a person may magnetically secure the guide to a stud that is only clamped in place in the intended framing structure, and then, without having to hold onto the guide itself, use two hands for measuring off a reference line or the like, for making the final adjustment before premanently securing the stud relative to the adjacent framing member. For example, with the guide inverted relative to the orientation of FIG. 1 and with the extended end 20 against the side leg 30, the axial location of the stud and the proper squaring of the stud with the base wall 40 of the track framing member 38 normel to the stud can be obtained by sliding the edge 22 against the top edges of both track walls 42 and 44. Again, before components are secured together, the stud 26 can be squared relative to the channel track 38, by securing the extended end 20 against one of the side walls of the channel track and the edge 22 slid flush against the wide side 32 (or flats 34) of the stud.

The guide 10 can also be left adhered to any metal framing member secured in place, while the person is doing other work, as a safe and temporary place for storing the guide, when not in use and not needed to be carried in the tool pouch on the person. However, as the adherence of the guide 10 to the framing member is magnetic and positive, this is different than merely setting the guide down, as on a ledge or the like, which could easily be knocked therefrom, to possibly damage the guide, and to endanger anyone or anything therebeneath that it may fall on.

What I claim is:

1. A guide for use primarily with a steel framing member such as a conventional "metal stud" having a narrow side and a wide side meeting across an exterior corner, the combination of an elongated planar body, and a planar cross bar disposed at one of the end edges of the elongated body, somewhat in the configuration of a "T";

the elongated body projecting from the cross bar a distance, of the order of 6–8 inches, to well exceed the width of the wide side of the "metal stud" framing member, the elongated planar member being of a triangular shape having adjacent edges disposed normal to one another, one of the edges of the elongated body and a corresponding edge of the cross bar lying in a common plane disposed normal to a corner intersection between the elongated body member and cross bar, one end of the cross bar projecting from the elongated body only a short distance, of the order of $\frac{1}{4}$ to $\frac{5}{8}$ of an inch, the other end of the cross bar projecting from the elongated body a much greater distance, of the order of $1\frac{1}{8}$ to $1\frac{1}{4}$ of an inch, to correspond to the width of the narrow side of the "metal stud" framing member, the other end of the cross bar being formed in part of a magnetic metal piece having a base wall, and short peripherial walls extended transverse to the base wall, magnet material having opposite flat faces, one flat face being secured against and to the base wall and the other flat face being coplanar with the end edges of the transverse walls, the magnet material and wall edges together defining a reference surface perpendicular to the elongated planar body and facing in the direction of the planar body along one side thereof and operable when positioned against the metal framing member to magnetically hold the guide in place against the metal framing member, the magnet material extending over a major portion, relative to the length and width of the extended cross bar end, operable to provide holding power sufficient to retain the guide to place against the framing member even without high density flux.

2. A marking guide according to the combination of claim 1, wherein the short peripherial walls are formed of a magnetic material, and are integral with the base wall.

3. A marking guide according to the combination of claim 2, wherein the one end of the cross bar and the elongated body are unitary with one another.

4. A guide according to the combination of claim 1, wherein the short peripherial walls are formed of a non-magnetic material and are formed as a unitary piece with the elongated body, wherein part of the cross bar has an opening therein to receive the magnet material, and wherein the magnetic metal piece is disposed over the opening adjacent the face of the magnet material remote from the coplanar flat reference face thereof.

5. A marking guide according to the combination of claim 1, wherein additional magnet material is on said elongated planar body member, operable with the previously mentioned magnet material in the other end of the cross bar and when positioned against the metal framing member to magnetically hold the guide in place against the metal framing member.

6. A marking guide according to the combination of claim 5, wherein further said additional magnet material is on said elongated planar body generally at a distance from said guide corner just short of the width of the stud, operable to cooperate with the metal stud on the wide side thereof immediately adjacent the opposite corner against which the guide is squared.

7. A marking guide according to the combination of claim 6, wherein further said additional magnet material is in the form of small discs secured in cutouts in the surface of the elongated body, and having an exterior face that is flush with said elongated body surface.

8. A guide for use primarily with a magnetic framing member having adjacent sides meeting at an exterior right-angle corner, the combination of an elongated planar body, and a planar cross bar formed off of the planar body at one end edge thereof, somewhat in the configuration of a "T";

said cross bar having substantially flat reference surfaces disposed substantially normal to the elongated body, and one and another of such reference surfaces facing in the direction of and along the planar body and on opposite sides thereof;

said cross bar being formed of a durable structural material and of magnet material;

the cross bar at the periphery of said one reference surface being formed of the durable material, and the cross bar within the periphery of the one reference surface being formed of the magnet material;

said durable structural material and said magnet material, being coplanar at said one reference surface; and the cross bar at said one and said other reference surfaces projecting away from the elongated body dissimilar distances, and the projection distance of said one reference surface being much greater than the projection distance of the other reference surface, of the order of between two and five times greater;

said guide, in use, being adapted to have said cross bar positioned against one side of the magnetic framing member, whereby said magnet material magnetically holds said guide as so positioned, and said elongated member thereupon projecting transversely away from the one magnetic framing member side.

9. A guide according to the combination of claim 8, further providing that the guide is adapted to be used with a standard metal stud framing member having at least one narrow side and at least one wide side, and wherein the one reference surface of the guide, when positioned against the narrow side of the metal stud while the guide is squared against the metal stud, is adapted to extend substantially to the edge of said narrow side of the metal stud remote from the wide side thereof.

10. A guide according to the combination of claim 9, wherein the elongated body is extended away from the cross bar a distance greater than the width of the wide side of the framing member, to project beyond the edge of the wide side of the framing member remote from the narrow side of the framing member, when the one reference surface of the guide is squared against such narrow side of the framing member.

11. A guide according to the combination of claim 8, wherein the distance of projection of said one reference surfaces away from the elongated body is of the order of between $1\frac{1}{8}$ and $1\frac{1}{4}$ of an inch, and the distance of projection of said other reference surfaces away from the elongated body is of the order of between $\frac{1}{4}$ and $\frac{5}{8}$ of an inch.

12. A guide according to the combination of claim 8, wherein said durable structural material is non-magnetic, and further including a backing piece disposed proximate the magnet material and remote from the one reference surface thereof, and said backing piece being formed of a magnetic material.

13. A guide according to the combination of claim 12, wherein said durable structural material has a through opening therein adapted to be filled by the magnet material, and said backing piece is disposed to cover the opening and to be immediately next to the magnet material and remote from the one reference surface.

14. A guide according to the combination of claim 12, wherein said elongated body and the periphery of the cross bar defining said one reference surface are unitary with one another and formed of the durable structural material.

15. A guide according to the combination of claim 8, wherein the cross bar, at the projection from the elongated member corresponding to the one reference surface, is formed of a magnetic metal piece having a base wall and short peripherial walls transverse thereto, and said magnet material having opposite flat surfaces, with one flat surface being secured against and to the base wall and the other flat surface being coplanar with the end edges of the transverse walls and together defining said one reference surface.

16. A guide according to the combination of claim 8, wherein yet a third of the cross bar reference surfaces is disposed to face in the direction away from the planar body, and such third reference surface is formed of durable structural material.

17. A guide according to the combination of claim 8, further having additional magnet material on said elongated body member so located to be positioned against the framing member, for magnetically holding said guide to the framing member.

18. A guide according to the combination of claim 17, wherein the additional magnet material is in the form of a small disc secured in a cutout in the surface of the elongated body, and having an exterior face that is coplanar with the exterior surface of the elongated body.

* * * * *